US010987721B2

(12) United States Patent
Takahashi

(10) Patent No.: US 10,987,721 B2
(45) Date of Patent: Apr. 27, 2021

(54) METHOD OF MANUFACTURING COIL SPRING AND COIL SPRING MANUFACTURING APPARATUS

(71) Applicant: ORII & MEC CORPORATION, Kanagawa (JP)

(72) Inventor: Takehito Takahashi, Kanagawa (JP)

(73) Assignee: ORII & MEC CORPORATION, Kanagawa (JP)

( * ) Notice: Subject to any disclaimer, the term of this patent is extended or adjusted under 35 U.S.C. 154(b) by 377 days.

(21) Appl. No.: 15/527,230

(22) PCT Filed: Jun. 25, 2015

(86) PCT No.: PCT/JP2015/068348
§ 371 (c)(1),
(2) Date: May 16, 2017

(87) PCT Pub. No.: WO2016/208033
PCT Pub. Date: Dec. 29, 2016

(65) Prior Publication Data

US 2018/0015529 A1 Jan. 18, 2018

(51) Int. Cl.
*B21F 3/04* (2006.01)
*B21F 35/00* (2006.01)
(Continued)

(52) U.S. Cl.
CPC ..... *B21F 3/04* (2013.01); *B21F 3/02* (2013.01); *B21F 35/00* (2013.01); *B21F 23/00* (2013.01)

(58) Field of Classification Search
CPC .... B21F 3/00; B21F 35/00; B21F 3/02; B21F 3/04
(Continued)

(56) References Cited

U.S. PATENT DOCUMENTS 2,276,579 A * 3/1942 Halvorsen ..... B21F 3/02 72/130
3,736,784 A * 6/1973 Felker ..... B21F 3/04 72/145
(Continued)

FOREIGN PATENT DOCUMENTS

JP 10020079 A * 1/1998 ..... Y02E 30/40
JP 3124489 B 10/2000
(Continued)

OTHER PUBLICATIONS

Takahashi, Translation JP-2002143963-A (Year: 2002).*
(Continued)

*Primary Examiner* — Adam J Eiseman
*Assistant Examiner* — Bobby Yeonjin Kim
(74) *Attorney, Agent, or Firm* — Roberts Calderon Safran & Cole P.C.

(57) ABSTRACT

A method of manufacturing a coil spring and a coil spring manufacturing apparatus are provided that enable precise forming of a coil spring even when various kinds of wire rods are used as a wire rod. This is based on the premise that the wire material being fed out is serially pressed against a rotating roller outer circumferential surface to form the wire rod into a coil shape. Under this premise, as the wire rod is fed out, a rotating roller is rotationally driven by a rotary drive force of a servomotor such that a portion pressed against the wire rod on the rotating roller outer circumferential surface moves toward the advancing side of the wire rod.

19 Claims, 11 Drawing Sheets

(51) Int. Cl.
*B21F 3/02* (2006.01)
*B21F 23/00* (2006.01)

(58) Field of Classification Search
USPC ..... 72/135, 145
See application file for complete search history.

(56) References Cited

U.S. PATENT DOCUMENTS 4,387,585 A * 6/1983 Cavagnero ..... B21F 3/02 72/131
4,569,216 A * 2/1986 Platt ..... B21F 3/04 72/138
5,301,529 A * 4/1994 Paybarah ..... H01F 41/082 72/142
2008/0245122 A1* 10/2008 Anagnostopoulos ..... B21F 3/04 72/138
2009/0258228 A1* 10/2009 Matsuoka ..... B21C 1/00 428/380
2016/0243607 A1* 8/2016 Takahashi ..... B21F 23/00
2017/0252867 A1* 9/2017 Bach ..... B21C 37/04
2018/0015529 A1* 1/2018 Takahashi ..... B21F 3/04

FOREIGN PATENT DOCUMENTS

JP 3124489 * 1/2001 ..... B21F 3/04
JP 2002143963 A * 5/2002 ..... B21F 35/00
JP 2002143963 A 5/2002
JP 2007-507357 A 3/2007
JP 2012-51025 A 3/2012

OTHER PUBLICATIONS

Abiru, Translation JP-10020079-A (Year: 1998).*
Kidooka, Translation of JP 3124489 (Translated Publication JPH1020079 from Espacenet) (Year: 2001).*
International Search Report and Written Opinion dated Sep. 29, 2015 in the corresponding application PCT/JP2015/068348.

* cited by examiner

METHOD OF MANUFACTURING COIL SPRING AND COIL SPRING MANUFACTURING APPARATUS

CROSS-REFERENCE TO RELATED APPLICATIONS

The present application is a U.S. National Phase of PCT/JP2015/068348 filed on Jun. 25, 2015. The disclosure of the PCT application is hereby incorporated by reference into the present application.

TECHNICAL FIELD

The present invention relates to a method of manufacturing a coil spring and a coil spring manufacturing apparatus.

BACKGROUND ART

In a proposed coil spring manufacturing apparatus, as described in Patent Document 1, a rotating body is rotatably supported as a coil forming tool via a support pin by a support tool, and a wire rod being fed out is serially pressed against an outer circumferential surface of the rotating body so as to form the wire rod into a coil shape while rotating the rotating body by the movement of the wire rod.

This makes it possible to reduce a frictional resistance of the wire rod with respect to the rotating body outer circumferential surface against which the wire rod is pressed and causes a problem of frictional force at the time of forming the wire rod into a coil shape, so that a deterioration in quality can be suppressed even without plating, or applying a lubrication oil to, the wire rod, in forming of a coil spring.

PRIOR ART DOCUMENT

Patent Document

Patent Document 1: Japanese Patent No. 3124489

SUMMARY OF THE INVENTION

Problem to be Solved by the Invention

However, in the coil spring manufacturing apparatus, since the rotating body is configured to rotate in accordance with the movement of the wire rod in contact with the rotating body outer circumferential surface, unless a frictional force of the wire rod with respect to the rotating body outer circumferential surface exceeds a resistance force (maximum static frictional force) of the rotating body with respect to the support tool (support pin), the wire rod slips on the outer circumferential surface of the rotating body and the rotating body does not rotate. Therefore, the wire rod must have a strength capable of enduring until the rotating body rotates with respect to the support tool (until the frictional force of the rotating body with respect to the support tool attains a dynamic frictional force through the maximum static frictional force) and, if a wire rod without such a strength is used, a coil spring acquired as a product may be low quality or the forming of the coil spring itself may become difficult.

The present invention was conceived in view of such a circumstance and it is therefore a first object of the present invention to provide a method of manufacturing a coil spring enabling precise forming of a coil spring even when various kinds of wire rods are used.

A second object is to provide a coil spring manufacturing apparatus enabling precise forming of a coil spring even when various kinds of wire rods are used.

Means for Solving Problem

To achieve the first object, the present invention is configured as a method of manufacturing a coil spring by serially pressing a wire rod being fed out against an outer circumferential surface of a rotating body serving as a coil forming tool to form the wire rod into a coil shape, and as the wire rod is fed out, the rotating body is rotationally driven by a rotary drive force of a rotary drive source such that a portion pressed against the wire rod on the outer circumferential surface of the rotating body moves toward the same side as the advancing side of the wire rod.

According to this configuration, it is no longer necessary for the drive force to generate a frictional force between the rotating body outer circumferential surface and the wire rod so as to rotate the rotating body based on the rotary drive of the rotating body by the rotary drive source, so that a limitation on wire rod strength attributable to the generation of the frictional force can be eliminated.

The following forms can be taken as preferable configuration forms of the present invention (first aspect of invention) on the premise of the configuration of the present invention (first aspect of invention).

(1) In a configuration that can be achieved, when the rotating body is rotationally driven, a circumferential speed of the outer circumferential surface of the rotating body is set close to a feed speed of the wire rod by using the feed speed of the wire rod as a target value.

As a result, a slip between the wire rod and the rotating body can be suppressed as much as possible, and the wiring rod is no longer necessary to have a strength capable of enduring until the rotating body starts rotating with respect to a support tool (until the frictional force of the rotating body with respect to the support tool attains a dynamic frictional force through a maximum static frictional force) and is also no longer necessary to have even a strength exceeding a rotational resistance force (dynamic frictional force) of the rotating body rotating with respect to the support, so that even if the wire rod with a lower strength is used, a coil spring can be manufactured.

Since a slip of the wire rod on the outer circumferential surface of the rotating body can be suppressed as much as possible, a damage of the outer circumferential surface of the wire rod can be prevented with high reliability. Accordingly, when the wire rod is a coated wire, a coat can be restrained from peeling due to the damage based on the slip.

(2) In a configuration that can be achieved based on the premise of (1) described above, a shaft-shaped pitch processing tool is provided, and when the wire rod is formed into a coil shape, the pitch processing tool is pressed against the wire rod to displace the wire rod in an axial direction of the coil spring to be formed for performing pitch processing, and as the wire rod is fed out, the pitch processing tool is rotationally driven by a rotary drive force of a pitch processing tool rotary drive source such that a portion pressed against the wire rod on an outer circumferential surface of the pitch processing tool moves toward the same side as the advancing side of the wire rod.

As a result, not only a pitch can be applied to the formed coil spring, but also it is no longer necessary for the drive force to generate a frictional force between the pitch processing tool outer circumferential surface and the wire rod so as to rotate the pitch processing tool around the axis thereof, and therefore, even if the pitch processing tool is provided, a limitation on wire rod strength attributable to the generation of the frictional force can be eliminated.

(3) In a configuration that can be achieved based on the premise of (2) described above, when the pitch processing tool is rotationally driven, a circumferential speed of the outer circumferential surface of the pitch processing tool is set close to a feed speed of the wire rod by using the feed speed of the wire rod as a target value.

As a result, in addition to the case of the rotating body, the pitch processing tool is configured in the same way, and even if the pitch processing tool is provided, the coil spring can precisely be formed and, moreover, a slip of the wire rod on the outer circumferential surface of the pitch processing tool can be suppressed as much as possible to prevent a damage of the outer circumferential surface of the wire rod with high reliability.

(4) In a configuration that can be achieved, a shaft-shaped pitch processing tool is provided, and when the wire rod is formed into a coil shape, the pitch processing tool is pressed against the wire rod to displace the wire rod in an axial direction of the coil spring to be formed for performing pitch processing, and as the wire rod is fed out, the pitch processing tool is rotationally driven by a rotary drive force of a pitch processing tool rotary drive source such that a portion pressed against the wire rod on an outer circumferential surface of the pitch processing tool moves toward the same side as the advancing side of the wire rod.

As a result, not only a pitch can be applied to the formed coil spring, but also it is no longer necessary for the drive force to generate a frictional force between the pitch processing tool outer circumferential surface and the wire rod so as to rotate the pitch processing tool around the axis thereof, and therefore, even if the pitch processing tool is provided, a limitation on wire rod strength attributable to the generation of the frictional force can be eliminated.

(5) In a configuration that can be achieved based on the premise of (4) described above, when the pitch processing tool is rotationally driven, a circumferential speed of the outer circumferential surface of the pitch processing tool is set close to a feed speed of the wire rod by using the feed speed of the wire rod as a target value.

As a result, in addition to the case of the rotating body, the pitch processing tool is configured in the same way, and even if the pitch processing tool is provided, the coil spring can precisely be formed and, moreover, a slip of the wire rod on the outer circumferential surface of the pitch processing tool can be suppressed as much as possible to prevent a damage of the outer circumferential surface of the wire rod with high reliability.

To achieve the second object, the present invention is configured as a coil spring manufacturing apparatus comprising: a rotating body having an outer circumferential surface against which a wire rod being fed out is serially pressed for forming into a coil shape, the rotating body being connected to a rotary drive source such that the rotating body is rotated around an axis of the rotating body, the rotary drive source rotationally driving the rotating body as the wire rod is fed out, the rotary drive source being set in relation to the rotary drive of the rotating body such that a portion pressed against the wire rod on the outer circumferential surface of the rotating body moves toward the same side as the advancing side of the wire rod.

With this configuration, as the wire rod is fed out, the rotating body is rotationally driven by the rotary drive force of the rotary drive source such that a portion pressed against the wire rod on the outer circumferential surface of the rotating body moves toward the advancing side of the wire rod, so that a coil spring manufacturing apparatus implementing the method of manufacturing a coil spring (the first aspect of invention) described above can be provided.

The following forms can be taken as preferable configuration forms of the present invention (second aspect of invention) on the premise of the configuration of the present invention (second aspect of invention).

(1) In a configuration that can be achieved, the rotary drive source is adjusted to set a circumferential speed of the outer circumferential surface of the rotating body close to a feed speed of the wire rod by using the feed speed of the wire rod as a target value.

As a result, a coil spring manufacturing apparatus implementing the method of (1) in the first aspect of invention can be provided.

(2) In a configuration that can be achieved based on the premise of (1) described above, the coil spring manufacturing apparatus comprises a wire rod guide straightly feeding out the wire rod, and a winding tool disposed adjacent to the wire rod guide to wind a wire rod fed out from the wire rod guide therearound, the rotating body is made up of a single rotating body, the winding tool has an arc-shaped outer circumferential surface around which the wire rod fed from the wire rod guide is wound, and the single rotating body is disposed to be bought into contact with the arc-shaped outer circumferential surface of the winding tool via the wire rod.

As a result, when a coil spring of a normal size is formed, the wire rod can obviously precisely be wound into a coil shape by a leading end of the wire rod guide, the single rotating body, and the winding tool, and even when the diameter of the coil spring to be formed is extremely small, a problem of interference between rotating bodies can be eliminated unlike the case of using a plurality of rotating bodies. Therefore, even in the case of forming a coil spring having an extremely small diameter, the coil spring can precisely be formed.

(3) In a configuration that can be achieved based on the premise of (1) described above, the coil spring manufacturing apparatus comprises a shaft-shaped pitch processing tool pressed against the wire rod to displace the wire rod in an axial direction of the coil spring to be formed for performing pitch processing when the wire rod is formed into a coil shape, the pitch processing tool is connected to a pitch processing tool rotary drive source such that the pitch processing tool is rotated around an axis of the pitch processing tool, and the pitch processing tool rotary drive source rotationally drives the pitch processing tool as the wire rod is fed out, and is set in relation to the rotary drive of the pitch processing tool such that a portion pressed against the wire rod on an outer circumferential surface of the pitch processing tool moves toward the same side as the advancing side of the wire rod.

As a result, a coil spring manufacturing apparatus implementing the method of (2) in the first aspect of invention can be provided.

(4) In a configuration that can be achieved based on the premise of (3) described above, the pitch processing tool rotary drive source is adjusted to set a circumferential speed of the outer circumferential surface of the pitch processing tool close to a feed speed of the wire rod by using the feed speed of the wire rod as a target value.

As a result, a coil spring manufacturing apparatus implementing the method of (3) in the first aspect of invention can be provided.

(5) The coil spring manufacturing apparatus comprises a shaft-shaped pitch processing tool pressed against the wire rod to displace the wire rod in an axial direction of the coil spring to be formed for performing pitch processing when the wire rod is formed into a coil shape, the pitch processing tool is connected to a pitch processing tool rotary drive source such that the pitch processing tool is rotated around an axis of the pitch processing tool, and the pitch processing tool rotary drive source rotationally drives the pitch processing tool as the wire rod is fed out, and is set in relation to the rotary drive of the pitch processing tool such that a portion pressed against the wire rod on an outer circumferential surface of the pitch processing tool moves toward the same side as the advancing side of the wire rod.

As a result, a coil spring manufacturing apparatus implementing the method of (4) in the first aspect of invention can be provided.

(6) In a configuration that can be achieved based on the premise of (5) described above, the pitch processing tool rotary drive source is adjusted to set a circumferential speed of the outer circumferential surface of the pitch processing tool close to a feed speed of the wire rod by using the feed speed of the wire rod as a target value.

As a result, a coil spring manufacturing apparatus implementing the method of (5) in the first aspect of invention can be provided.

Effect of the Invention

From the above, the present invention can provide a method of manufacturing a coil spring and a coil spring manufacturing apparatus enabling precise forming of a coil spring even when various kinds of wire rods are used.

MODES FOR CARRYING OUT THE INVENTION

Embodiments of the present invention will now be described with reference to the drawings.

Before explaining a method of manufacturing a coil spring by forming a wire rod used as a forming material into a coil spring, a coil spring manufacturing apparatus using the method will first be described.

Figure 1:
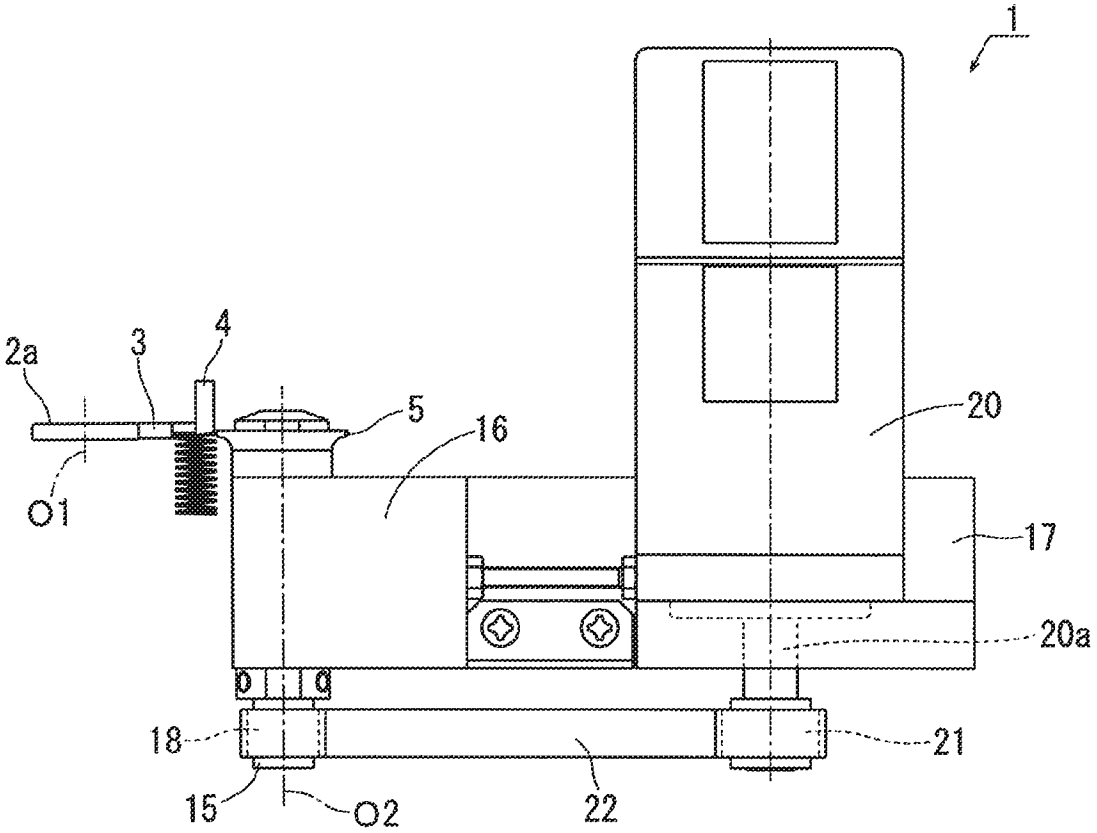
FIG. 1 is a plane view of a coil spring manufacturing apparatus according to a first embodiment.
Figure 2:
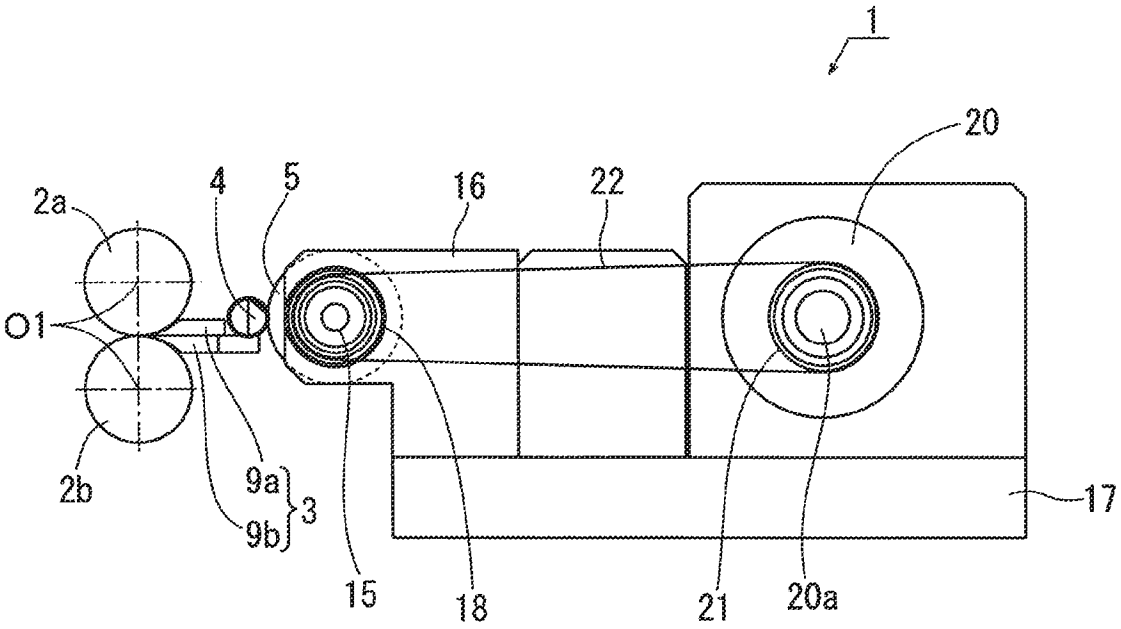
FIG. 2 is a front view of FIG. 1.
Figure 3:
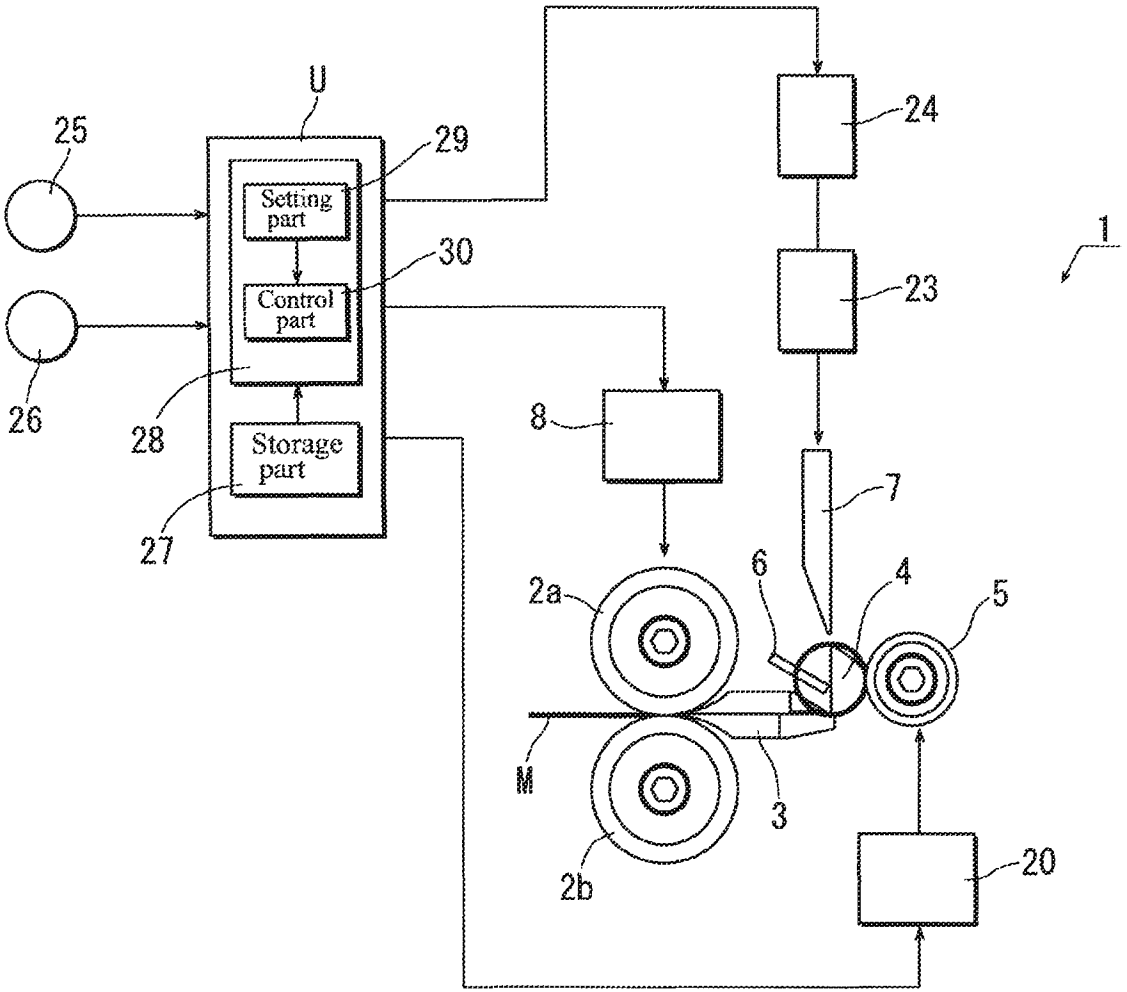
FIG. 3 is an overall configuration diagram of a coil spring manufacturing apparatus according to the first embodiment.

As shown in FIGS. 1 to 3, a coil spring manufacturing apparatus 1 includes a pair of feed rollers 2*a*, 2*b*, a wire rod guide 3, a cored bar 4 serving as a winding tool, a rotating roller 5 serving as a rotating body (coil forming tool), a pitch processing tool 6 (not shown in FIGS. 1 and 2), and a cutter 7 (not shown in FIGS. 1 and 2) serving as a cutting tool. The pair of the feed rollers 2*a*, 2*b*, the wire rod guide 3, the cored bar 4, and the rotating roller 5 are arranged in order from one side to the other side of the coil spring manufacturing apparatus 1 (from the left side to the right side of FIGS. 1 to 3), and the pitch processing tool 6 is disposed above the wire rod guide 3 while the cutter 7 is disposed above the cored bar 4.

The pair of the feed rollers 2*a*, 2*b* are arranged in a vertical relationship so as to feed a wire rod M toward the wire rod guide 3. The paired feed rollers 2*a*, 2*b* have respective rotation axes O1 oriented in a direction (direction perpendicular to the plane of FIGS. 2 and 3) crossing a feed direction of the wire rod M (rightward direction of FIGS. 1 to 3), and the circumferential surfaces of the two feed rollers 2*a*, 2*b* are close to each other with the width direction of the circumferential surfaces oriented in the direction of the rotation axes O1. A servomotor 8 serving as a rotary drive source is connected to at least one of the feed rollers 2*a*, 2*b*, and the paired feed rollers 2*a*, 2*b* are rotated in respective directions opposite to each other by a drive force of the servomotor 8, so that the wire rod M is fed out by the rotation of the pair of the feed rollers 2*a*, 2*b* from between the two rollers 2*a*, 2*b* toward the other side of the coil spring manufacturing apparatus 1.

Figure 4:
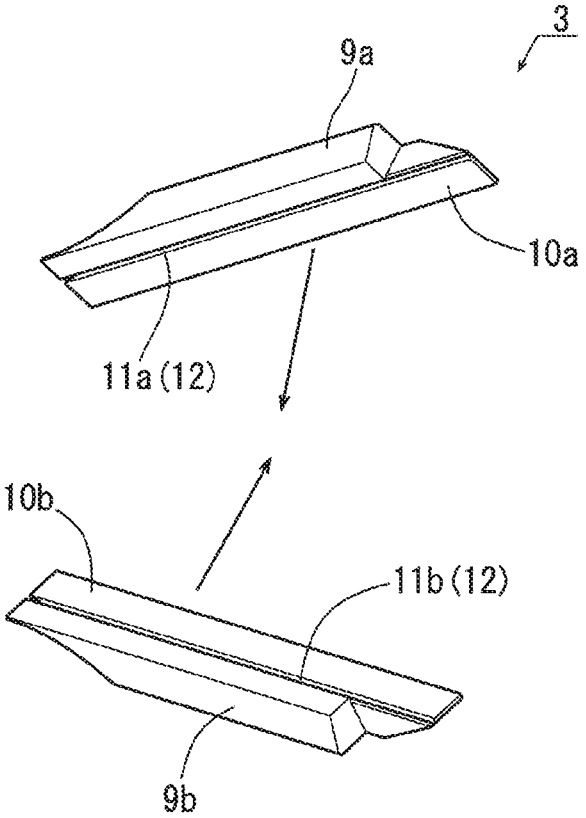
FIG. 4 is an exploded perspective view for explaining a wire rod guide used in the first embodiment.

To guide the wire rod M fed out from the pair of the feed rollers 2*a*, 2*b* in a straightly extended manner, as shown in FIG. 4, the wire rod guide 3 has a structure acquired by combining a pair of guide members 9*a*, 9*b*. Guide grooves 11*a*, 11*b* are respectively formed on mating surfaces 10*a*, 10*b* of the pair of the guide members 9*a*, 9*b*, and a guide hole 12 (see also FIG. 6) substantially allowing passage of the wire rod M is formed inside the wire rod guide 3 based on the guide grooves 11*a*, 11*b*.

As shown in FIGS. 1 to 3, 5, and 6, the cored bar 4 forms the wire rod M fed out from the wire rod guide 3 into a predetermined coil shape in cooperation with the rotating roller 5 described later, and the wire rod M is wound around the outer circumferential surface of the cored bar 4 at the time of forming.

In the present embodiment, the cored bar 4 is integrally attached to an attaching member not shown. The cored bar 4 is extended in a shaft shape in the same direction as the axes O1 of the feed rollers 2*a*, 2*b*, and a leading end portion of the cored bar 4 is disposed adjacent to the wire rod guide 3 at a position above a leading end opening of the guide hole 12 of the wire rod guide 3. This cored bar 4 is formed into a substantially semicircular shape in a front view of FIG. 6, and the outer circumferential surface of the cored bar 4 has a cutter guide surface 13 directed toward the wire rod guide 3 in a state of forming a flat surface, and a remaining arc-shaped forming surface 14. The forming surface 14 has a first outer circumferential surface part 14*a* and a second outer circumferential surface part 14*b* in order in a winding direction (counterclockwise direction of FIG. 6) of the wire rod M fed out from the wire rod guide 3, and a curvature radius R2 of the second outer circumferential surface part 14*b* is larger than a curvature radius R1 of the first outer circumferential surface part 14*a*.

The cored bar 4 has a diameter corresponding to the inner diameter of the coil spring to be formed and, if the inner diameter of the coil spring to be formed is made extremely small, the cored bar 4 having an extremely small diameter of 1 mm or less may accordingly be used.

Figure 6:
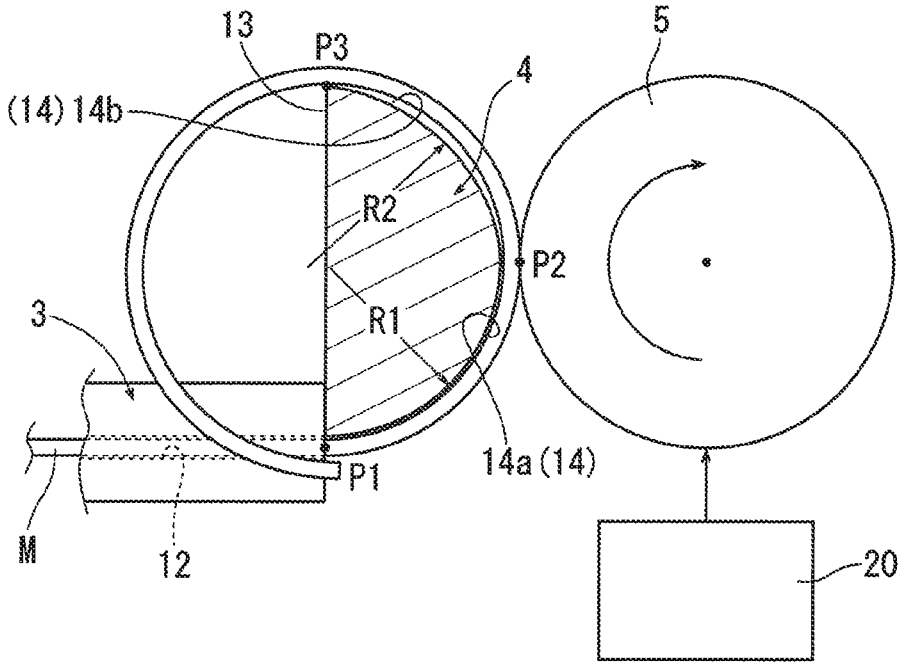
FIG. 6 is an explanatory view for explaining the coil spring forming in the first embodiment.

In FIG. 6, the wire rod guide 3 is shown in a simplified manner.

As shown in FIGS. 1 and 2, the rotating roller 5 is provided via a rotating shaft 15 and a bearing 16 on a base 17 for curvature forming of the wire rod M fed out from the wire rod guide 3 in cooperation with the cored bar 4.

A band plate-shaped member is used for the base 17, and the base 17 has one end side disposed close to the wire rod guide 3 and the cored bar 4 and the other end side attached to an attaching member not shown with a longitudinal direction thereof oriented in the extension direction of the coil spring manufacturing apparatus 1 (the horizontal direction of FIGS. 1 to 3). The bearing 16 is fixed to an upper surface on the one end side of the base 17, and an axis O2 of the bearing 16 is oriented in the same direction as the axes O1 of the feed rollers 2*a*, 2*b*. The rotating shaft 15 is rotatably supported by the bearing 16 in a state of penetrating the bearing 16, and the rotating roller 5 is attached to one end portion of the rotating shaft 15 while a pulley 18 is attached to the other end portion of the rotating shaft 15.

As shown in FIG. 6, the rotating roller 5 is disposed such that a lower portion of an outer circumferential surface 5*a* thereof faces a leading end opening P1 of the guide hole 12 in the wire rod guide 3 while a circumferential surface portion P2 above the portion comes close to the first outer circumferential surface portion 14*a* of the cored bar 4. As a result, when the wire rod M is fed out, the rotating roller 5 forms the wire rod M into a coil shape in cooperation with the cored bar 4 and the wire rod guide 3 described above.

Specifically, in the state of the wire rod M guided from the leading end opening P1 of the guide hole 12 to the point P2 on the outer circumferential surface of the rotating roller 5, the wire rod M is formed into a curved shape along the first outer circumferential surface portion 14*a* based on pressing against the outer circumferential surface 5*a* of the rotating roller 5. When the wire rod M is further fed out and a curvature forming portion formed into a curved shape at the point P1 and the point P2 reaches an end P3 of the second outer circumferential surface part 14*b* in the winding direction of the wire rod M (counterclockwise direction of FIG. 6), the end P3 of the second outer circumferential surface part 14*b* and the curvature forming portion comes into contact with each other based on the fact that the curvature radius R2 of the second outer circumferential surface portion 14*b* is larger than the curvature radius R1 of the first outer circumferential surface portion 14*a*, so that the curvature radius of the curvature forming portion is slightly increased. Such forming is serially performed as the wire rod M is fed out, and the wire rod M is formed into a coil shape.

Figure 5:
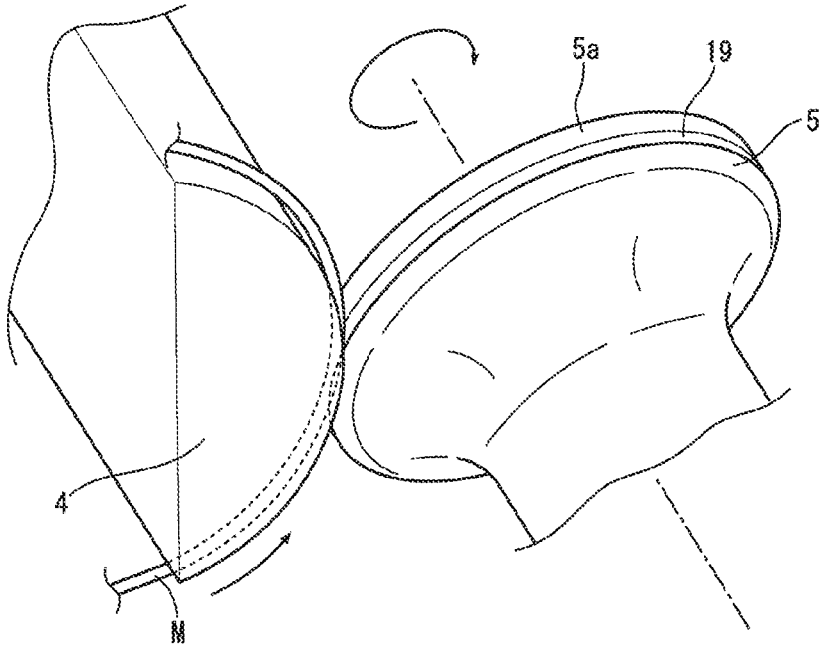
FIG. 5 is a partially enlarged perspective view of a relationship between a rotating roller and a wire rod according to the first embodiment.

As shown in FIG. 5, a guide groove 19 is formed over the entire circumference of the outer circumferential surface 5*a* of the rotating roller 5. The guide groove 19 has a function of guiding the wire rod M led to the rotating roller outer circumferential surface 5*a*, and when the wire rod M is located at the point P2 on the rotating roller outer circumferential surface 5*a* (a pressing point of the wire rod M against the outer circumferential surface 5*a*), a portion of the wire rod M enters the guide groove 19, so that the rotating roller 5 and the first outer circumferential surface part of the cored bar 4 are certainly brought into contact with each other via the wire rod M at the point P2, and is then guided such that the feed-out direction of the portion is oriented to a point P3. As a result, the forming described above (forming the wire rod M into a coil shape) is precisely performed.

As shown in FIGS. 1 and 2, a servomotor 20 serving as a rotary drive source is associated with the pulley 18 of the rotating shaft 15. The servomotor 20 is fixed to the upper surface on the other end side of the base 17 such that an output shaft 20 thereof is oriented in the same direction as the other axial end side of the rotating shaft 15, and a pulley 21 is attached to the output shaft 20*a*. A belt 22 is wound around the pulley 21 and the pulley 18 of the rotating shaft 15 so that the drive force of the servomotor 20 is transmitted through the rotating shaft 15 to the rotating roller 5.

For forming a coil spring, the pitch processing tool 6 is formed into a shaft shape as shown in FIG. 3 so as to apply a pitch to the coil spring and is disposed such that a portion on one end side thereof enters a region of the coil spring to be formed from obliquely above. When a coil spring is formed, the whole of the pitch processing tool 6 is displaced forward in the axial direction of the coil spring from the guide groove 19 of the rotating roller 5 (in the direction toward the near side on the plane of FIG. 3), and an outer circumferential surface of the pitch processing tool 6 is brought into contact with the rear side of the wire rod M wound in a coil shape. As a result, as the wire rod M is serially wound around the cored bar 4, a pitch is serially formed in the axial direction in the coil spring to be formed.

The cutter 7 is coupled to a servomotor 24 serving as a rotary drive source via a reciprocation converting mechanism 23 as shown in FIG. 3 so as to cut off a coil spring formed in a predetermined axial length from the subsequent wire rod M. The cutter 7 can be reciprocated in the vertical direction by the drive force of the servomotor 24 and, when the cutter 7 moves downward, the cutter 7 cooperates with the cutter guide surface 13 described above to cut the wire rod M on the cored bar 4 (the point P3) so that the formed coil spring is cut off from the wire rod M.

In this coil spring manufacturing apparatus 1, various kinds of wire rods can be used as the wire rod M. Specifically, from the viewpoint of material, spring steel wires represented by stainless steel wires, piano wires, etc. and soft wires represented by copper wires, platinum wires, etc. are usable; from the viewpoint of diameter, not only those in a typical range of 0.3 to 5.0 mm but also those having an extremely small diameter, for example, less than 0.3 mm are usable depending on the intended use; and furthermore, a coated wire having a core material coated with a resin (e.g., a fluororesin such as polytetrafluoroethylene) can also be used as the wire rod M.

As shown in FIG. 3, the coil spring manufacturing apparatus 1 includes a control unit U so as to control the servomotors 8, 20, 24.

Therefore, input information from an operation input part 25 and input information (feed information of the wire rod M) from an encoder 26 in the servomotor 8 are input to the control unit U, and control signals are output from the control unit U to the servomotor 8, the servomotor 20, and the servomotor 24.

As shown in FIG. 3, the control unit U includes a storage part 27 and a control calculation part 28 so as to ensure the function as a computer.

Various programs, setting information, etc. necessary for forming a coil spring are stored in the storage part 27, and these various programs etc. are read out by the control calculation part 28 as needed. Additionally, necessary information is stored as appropriate.

As shown in FIG. 3, the control calculation part 28 functions as a setting part 29 and a control part 30 based on deployment of the program read out from the storage part 27.

The setting part 29 sets a feed length of the wire rod M, a speed of feeding of the wire rod M by the feed rollers 2*a*, 2*b*, a circumferential speed of the rotating roller outer circumferential surface 5*a*, etc. for forming a predetermined coil spring, and the control part 30 outputs various control signals under the various programs to the servomotor 8, the servomotor 20, and the servomotor 24 based on the setting information in the setting part 29.

A specific operation of the coil spring manufacturing apparatus 1 according to the present embodiment will be described together with a method of manufacturing a coil spring used in the coil spring manufacturing apparatus 1.

When the wire rod M is formed into a predetermined coil spring, the predetermined coil spring and the subsequent wire rod M are cut at the point P3 (see FIG. 6), and the cut end of the wire rod M is used as a manufacturing start end for a new coil spring. Therefore, in the following description, a start point is a state in which the leading end of the wire rod M pulled out from the wire rod guide 3 has reached the point P3 through between the cored bar 4 and the rotating roller 5.

When the coil spring manufacturing apparatus 1 determines that forming of a new coil spring should be started, the pair of the feed rollers 2*a*, 2*b* is rotationally driven and the wire rod M is fed out toward the wire rod guide and the fed wire rod M is serially curved and formed into a coil shape by the wire rod guide 3, the cored bar 4, and the rotating roller 5 (see FIG. 6). In this case, in the present embodiment, pitch processing is performed, and the pitch processing tool 6 is displaced in the axial direction of the coil spring to be formed.

Subsequently, when the coil spring manufacturing apparatus 1 determines that the predetermined coil spring is formed from the wire rod M fed out by a predetermined length by the rotation of the pair of the feed rollers 2*a*, 2*b*, the rotary drive of the pair of the feed rollers 2*a*, 2*b* is stopped, and the wire rod M placed on the cored bar 4 (the point P3) is then cut by the cutter 7.

Figure 7:
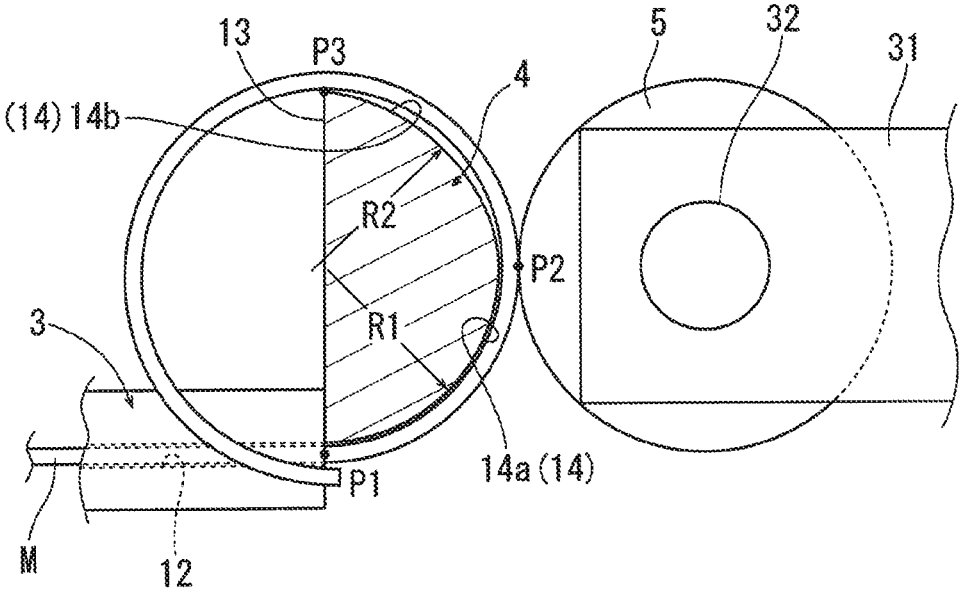
FIG. 7 is an explanatory view for explaining the coil spring forming in a comparative example.

In this case, in the present embodiment, the rotating roller 5 is rotationally driven in synchronization with the rotary drive of the feed rollers 2*a*, 2*b*. The form of the present embodiment will be described in detail in comparison with a comparative example having a form in which the rotating roller 5 is not rotationally driven by a rotary drive source and is simply rotatably supported by a support tool 31 via a support pin 32 (see FIG. 7). In FIG. 7 showing the comparative example, the same constituent elements as those in the present embodiment are denoted by the same reference numerals.

(1) Case of Form of Comparative Example (See FIG. 7)

Figure 8:
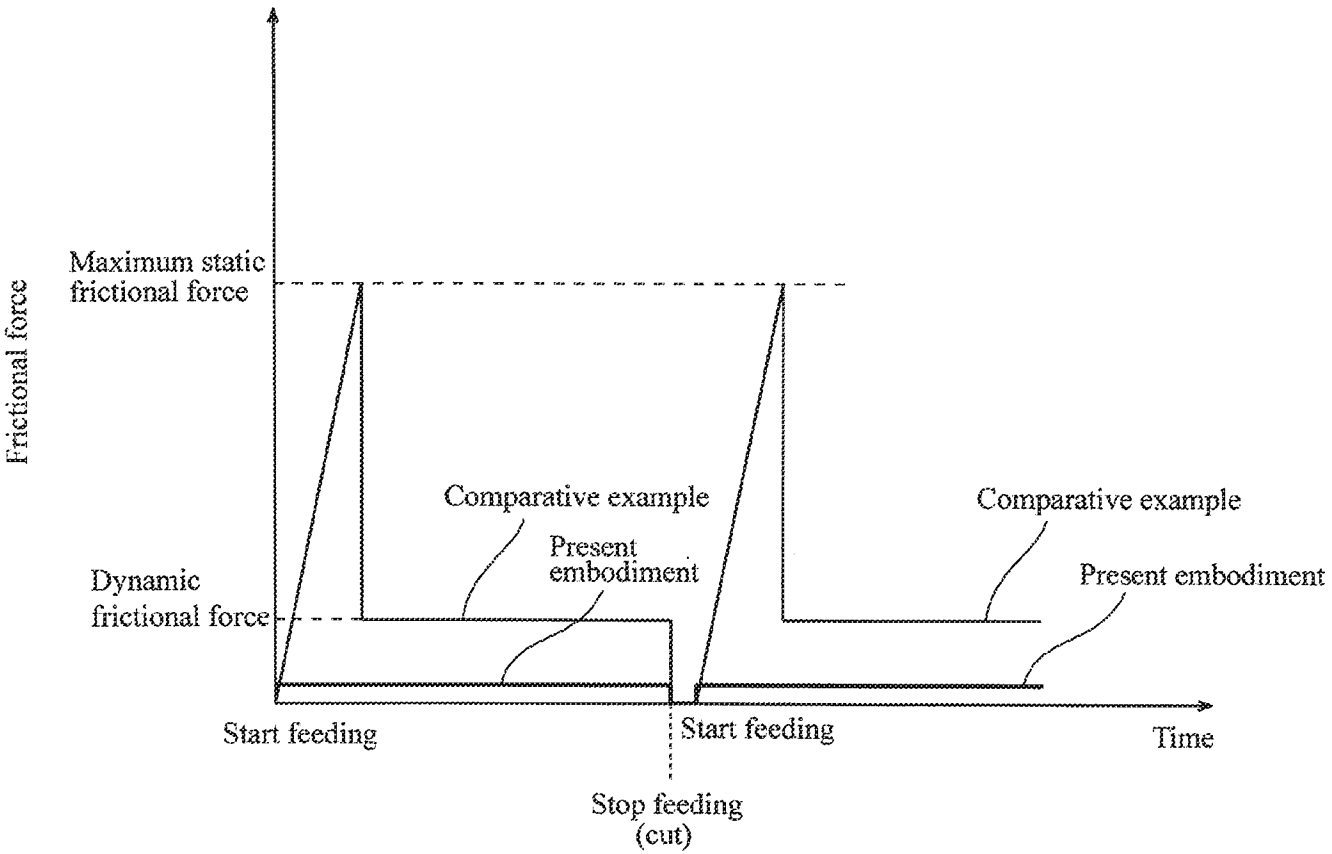
FIG. 8 is a conceptual diagram for explaining the present invention.

When the wire rod M is fed out by the pair of the feed rollers 2*a*, 2*b* under the state in which the wire rod M pulled out from the wire rod guide 3 is pressed against the outer circumferential surface of the rotating roller 5, a frictional force is generated as shown in FIG. 8 between the wire rod M and the outer circumferential surface of the rotating roller 5 as the wire rod M moves; however, unless the frictional force exceeds the maximum static frictional force of the rotating roller 5 with respect to the support pin 32, the wire rod M slips and moves on the outer circumferential surface of the rotating roller 5, and the rotating roller 5 does not rotate. Therefore, to utilize a low frictional force (dynamic frictional force) based on the rotation of the rotating roller 5 under the form of this comparative example, the frictional force between the wire rod M and the outer circumferential surface of the rotating roller 5 must exceed the maximum static frictional force of the rotating roller 5 with respect to the pin 32 so that the rotating roller 5 enters a rotating state relative to the support tool, and the dynamic frictional force (low frictional force) in this case can be utilized only after this rotational state is achieved. Therefore, the wire rod M must have a strength capable of enduring until the rotating roller 5 rotates with respect to the support pin 32 (until the frictional force of the rotating body with respect to the support pin 32 attains the dynamic frictional force through the maximum static frictional force) and, if a wire rod without such a strength is used as the wire rod M, a coil spring acquired as a product may be low quality or the forming of the coil spring itself may become difficult due to buckling etc.

Therefore, in the case of the wire rod M having a particularly low wire rod strength such as the soft wires described above and the wire rod M having a diameter less than 0.3 mm, it is not easy to forma coil spring because of occurrence of buckling etc.

Additionally, since the wire rod M slips on the outer circumferential surface of the rotating roller 5 until the frictional force of the rotating roller 5 with respect to the support pin 32 reaches the maximum static frictional force, the outer circumferential surface of the wire rod M may be damaged based on the slip. Therefore, if the wire rod M is a coated wire having a core material coated with a resin, peeling may occur in a coat thereof due to a damage based on the slip. Particularly, if a guide groove (corresponding to the guide groove 19 of the present embodiment) is formed on the outer circumferential surface of the rotating roller 5, an opening edge etc. of the guide groove 19 may locally act on the outer circumferential surface of the coated wire, and the peeling of the coat may be promoted by a slip occurring therebetween.

(2) Case of Form of Present Embodiment (See FIG. 6)

(i) In contrast, in the present embodiment, the rotating roller 5 is rotationally driven by the servomotor 20 in synchronization with the rotary drive of the feed rollers 2*a*, 2*b* such that a portion pressed against the wire rod M on the rotating roller outer circumferential surface 5*a* moves to the same side as the advancing side of the wire rod M (rotationally driven in the clockwise direction of FIG. 6). Therefore, in the present embodiment, it is no longer necessary for the drive force to increase the frictional force between the wire rod M and the outer circumferential surface 5*a* of the rotating roller 5 to the maximum static frictional force and, as shown in FIG. 8, the frictional force of the wire rod M with respect to the outer circumferential surface of the roller 5 can significantly be reduced, and the strength necessary for the wire rod M can markedly be lowered as compared to the case of the form of the comparative example.

(ii) Particularly, if the rotating roller 5 is rotationally driven such that the circumferential speed of the rotating roller outer circumferential surface 5*a* is made as close as possible to the feed speed of the wire rod M by using the feed speed of the wire rod M as a target value (most preferably, if the feed speed of the wire rod M and the circumferential speed of the roller outer circumferential surface 5*a* are made equal), a slip between the wire rod M and the rotating roller outer circumferential surface 5*a* can almost be eliminated, and the wiring rod M is no longer necessary to have the strength capable of enduring until the rotating roller 5 starts rotating with respect to the support tool (until the frictional force of the rotating body with respect to the support tool attains the dynamic frictional force through the maximum static frictional force) and is also no longer necessary to have even a strength exceeding a rotational resistance force (dynamic frictional force) of the rotating roller 5 rotating with respect to the support pin 32 described above, so that even if the wire rod M with an extremely low strength is used, a coil spring can be manufactured.

(iii) Therefore, even when a wire rod with a particularly low wire rod strength such as the soft wire described above and the wire rod M having a diameter less than 0.3 mm is used as the wire rod M, the wire rod M can precisely be formed into a coil spring without causing buckling etc.

(iv) In this case, if a wire rod having a diameter less than 0.3 mm is used as the wire rod M to forma coil spring having an inner diameter of about 1 mm, the coil spring can be used as a contact probe, a catheter, etc., and in the forming of such a coil with an extremely small diameter, the coil spring manufacturing apparatus 1 described above provided with the only one rotating roller 5 (see FIGS. 1 to 3 and 6) is preferably used. This is because in the case of the one rotating roller 5, even if the diameter of the coil spring to be formed is made smaller, a problem of interference between the rotating rollers 5 does not occur unlike the case of the coil spring manufacturing apparatus provided with the plurality of (generally two) rotating rollers 5 (see FIG. 1 of Patent Document 1).

Figure 9:
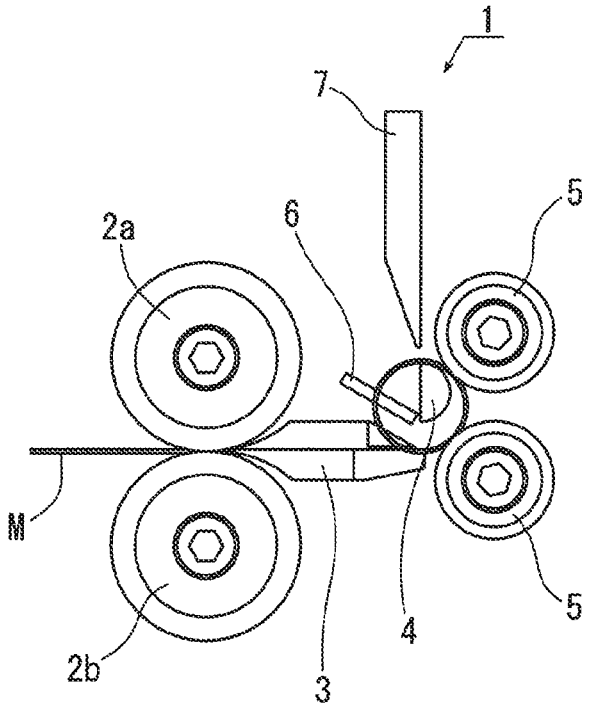
FIG. 9 is an explanatory view for explaining the coil spring forming in a form different from the first embodiment.
Figure 10:
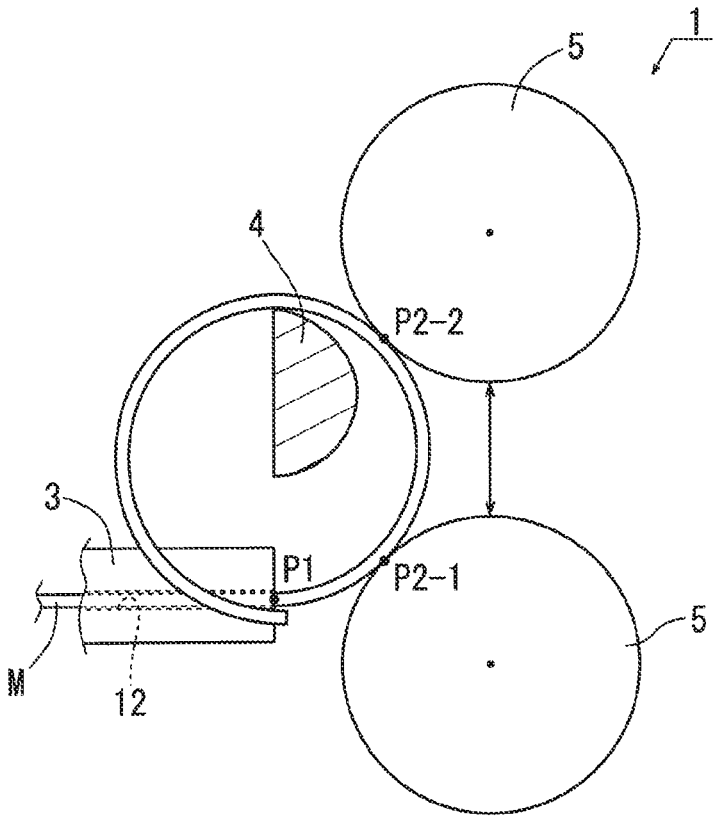
FIG. 10 is an explanatory view of arrangement, configuration, etc. of a wire rod guide, a cored bar, and a rotating body of a coil spring manufacturing apparatus of FIG. 9.

Description will specifically be made with reference to FIGS. 9 and 10. FIGS. 9 and 10 show the coil spring manufacturing apparatus 1 including the two rotating rollers 5. This coil spring manufacturing apparatus 1 includes the same constituent elements as those of the coil spring manufacturing apparatus 1 described above (FIGS. 1 to 3 and 6), and the same constituent elements are denoted by the same reference numerals.

In this coil spring manufacturing apparatus 1, the two rotating rollers 5 are respectively arranged at an angle of about 45 degrees above and below a horizontal line passing through an axis of a coil spring to be formed, and the wire rod M is pressed in a curved state against the rotating rollers 5. As a result, this coil spring manufacturing apparatus 1 can precisely form the wire rod M into the coil spring at points P2-1, P2-2 of pressing by the two rotating rollers 5 against the wire rod M and the point P1 at the leading end opening of the guide hole 12 of the wire rod guide 3 for the wire rod M (three points) (in FIG. 10, the cutter 7 and the pitch processing tool 6 are not shown). Obviously, also in this case, if the two rotating rollers 5 are rotationally driven by the servomotor 20 as described above, the wire rod M can be formed into a coil spring even when a wire rod with a weak strength is used as the wire rod M.

However, for example, when a wire rod having a diameter less than 0.3 mm is used as the wire rod M to forma coil spring having a diameter equal to or less than the diameter of each of the rotating rollers 5, although the diameter of the cored bar 4 can be reduced as the diameter of the coil spring to be formed becomes smaller, the outer diameter of each of the two rotating rollers 5 cannot be reduced so much, while the arrangement relationship between the two rotating rollers 5 (respectively pressing against the wire rod M from the angular positions of approx. 45 degrees above and below the horizontal line) cannot be changed even if the diameter of the coil spring to be formed becomes smaller. Therefore, in the coil spring manufacturing apparatus including the two rotating rollers 5, the possibility of interference between the two rotating rollers 5 increases as the diameter of the coil spring to be formed is made smaller (see an interval indicated by an arrow between the two rollers 5, 5 in FIG. 10). From the above, when a coil spring having a diameter equal to or less than the diameter of the rotating roller 5 described above is formed, preferably, the coil spring manufacturing apparatus 1 described above (see FIGS. 1 to 3 and 6) is used.

(v) If the circumferential speed of the rotating roller outer circumferential surface 5*a* is made substantially equal to the feed speed of the wire rod M, the slip of the wire rod M on the rotating roller outer circumferential surface 5*a* can almost be eliminated, and the outer circumferential surface of the wire rod M can be prevented from being damaged based on the slip M. Accordingly, if the wire rod is a coated wire, the peeling of the coat caused due to the damage based on the slip can be prevented and, under the condition that the guide groove 19 is formed on the rotating roller outer circumferential surface 5*a*, the peeling of the coat of the coated wire based on the guide groove 19 can be prevented.

Figure 11:
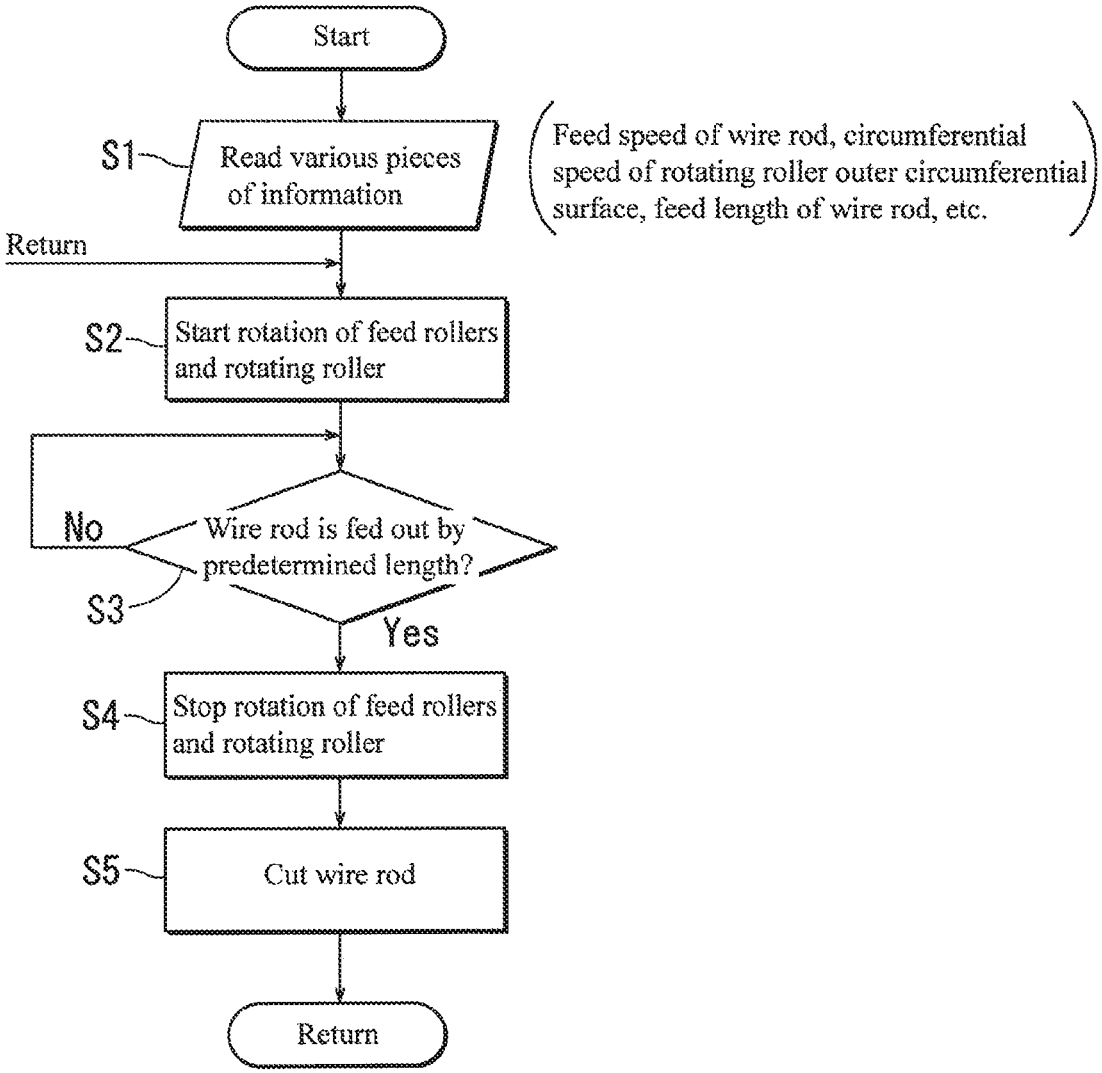
FIG. 11 is a flowchart of a control example of the coil spring manufacturing apparatus according to the first embodiment.

Specific operations of the method of manufacturing a coil spring according to the present embodiment and the coil spring manufacturing apparatus 1 using the method of manufacturing a coil spring will more specifically be described with reference to a flowchart of FIG. 11 showing a control example of the control unit U. It is noted that S stands for step. In the description, the start point is the state in which the leading end of the wire rod M is located at the point P3 as described above.

When the coil spring manufacturing apparatus 1 is started, at S1, various pieces of information are read such as the length of feeding of the wire rod M at a time by the feed rollers 2*a*, 2*b*, the speed of feeding of the wire rod M by the feed rollers 2*a*, 2*b*, and the circumferential speed of the rotating roller outer circumferential surface 5*a* (the speed substantially equal to the speed of feeding of the wire rod M by the feed rollers 2*a*, 2*b*) and, when the reading is completed, the rotations of the feed rollers 2*a*, 2*b* and the rotating roller 5 are started at S2 at the same time. In this case, the speed of feeding of the wire rod M by the feed rollers 2*a*, 2*b* is substantially equal to the circumferential speed of the outer circumferential surface 5*a* of the rotating roller 5, so that the frictional force of the wire rod M with respect to the rotating roller outer circumferential surface 5*a* can almost be eliminated. Therefore, various kinds of wire rods can be formed as the wire rod M, including not only those having a normal diameter (normal strength) but also those having a low wire rod strength, or particularly, those used for making the diameter of the coil spring to be formed extremely small.

At next step S3, it is determined based on an output signal from the encoder 26 in the servomotor 8 whether the feed rollers 2*a*, 2*b* have fed out the wire rod M by a predetermined length. This is performed for determining whether a coil spring with a predetermined axial length is formed. When S3 is NO, the determination of S3 is repeated to continue the forming of the coil spring, and when S3 is YES, the rotary drives of the feed rollers 2*a*, 2*b* and the rotating roller 5 are stopped at S4. This is because it is determined that a coil spring having a predetermined axial length is formed.

Subsequently, at S5, the cutter 7 is moved downward, and the cutter 7 and the cored bar 4 (the cutter guide surface 13) cooperate to cut off the formed coil spring from the subsequent wire rod M. When S5 is completed, a return is made to S2 described above so as to form the next coil spring.

Figure 12:
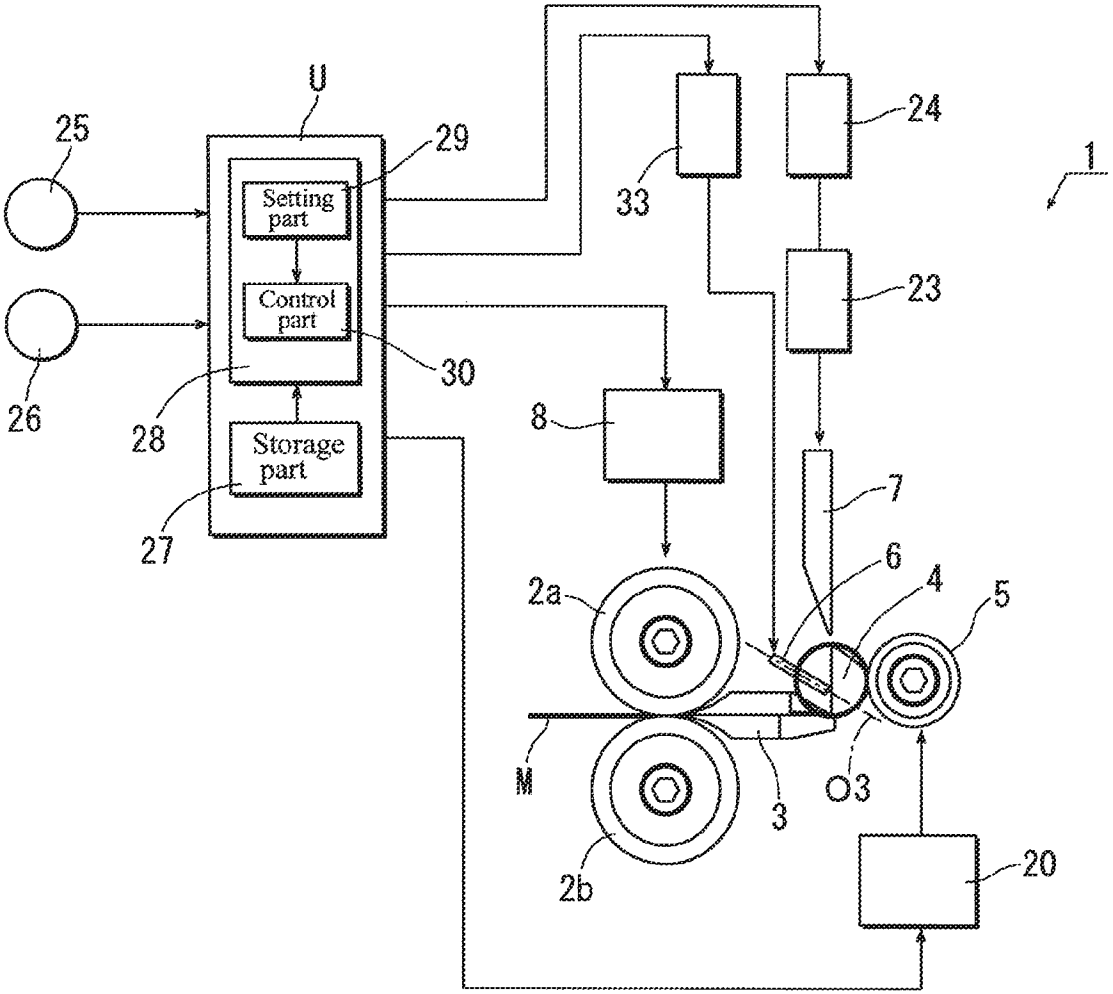
FIG. 12 is an overall configuration diagram of a coil spring manufacturing apparatus according to a second embodiment.
Figure 13:
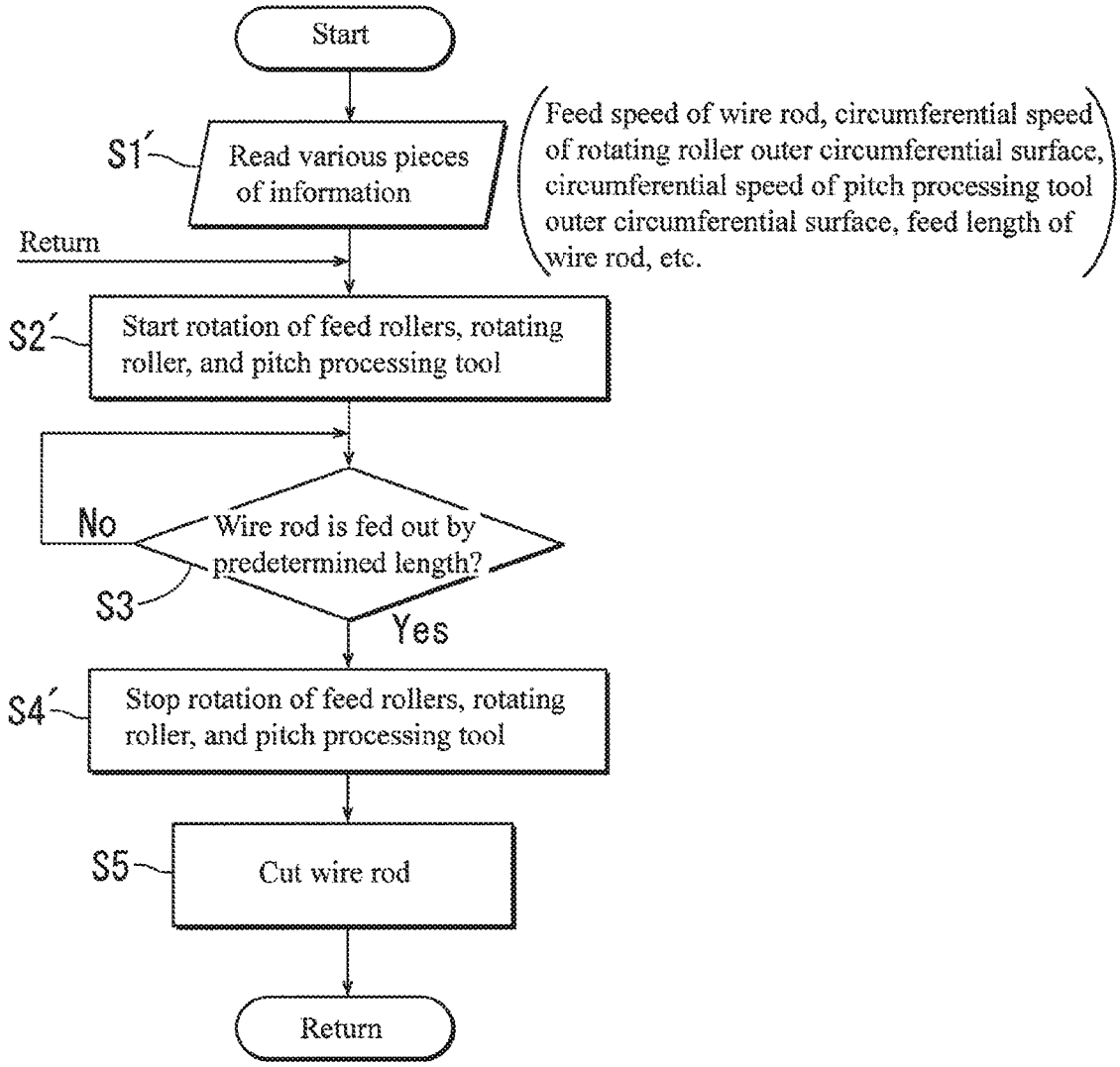
FIG. 13 is a flowchart of a control example of the coil spring manufacturing apparatus according to the second embodiment.
Figure 14:
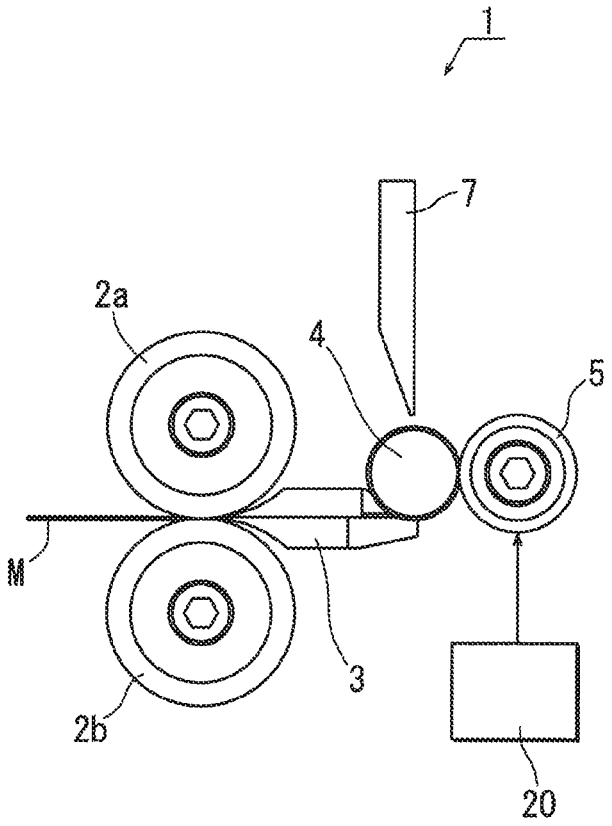
FIG. 14 is an explanatory view for explaining a coil spring manufacturing apparatus according to a third embodiment.

FIGS. 12 and 13 show a second embodiment, and FIG. 14 shows a third embodiment. In these embodiments, the same constituent elements as those of the first embodiment are denoted by the same reference numerals and will not be described.

In the second embodiment shown in FIGS. 12 and 13, the pitch processing tool 6 is not only displaced in the axial direction of the coil spring to be formed, but also rotationally driven about an axis O3 of the pitch processing tool 6.

Specifically, a pitch processing tool servomotor 33 is connected to the pitch processing tool 6 so as to rotate the pitch processing tool 6 around the axis O3, and the servomotor 33 rotationally drives the pitch processing tool 6 as the wire rod M is fed out, and is set in relation to the rotary drive of the pitch processing tool 6 such that a portion pressed against the wire rod M on the outer circumferential surface of the pitch processing tool 6 moves toward the same side as the advancing side of the wire rod M. Moreover, the circumferential speed of the outer circumferential surface of the pitch processing tool 6 is also set substantially equal to the speed of feeding of the wire rod M by the feed rollers 2*a*, 2*b*.

As a result, not only the pitch can be applied to the formed coil spring, but also it is no longer necessary for the drive force to generate a frictional force between the outer circumferential surface of the pitch processing tool 6 and the wire rod M so as to rotate the pitch processing tool 6 around the axis O3, and therefore, even if the pitch processing tool 6 is provided, a problem of the strength of the wire rod M attributable to the generation of the frictional force can be eliminated.

FIG. 13 is a flowchart of a control example of the control unit U according to the second embodiment. Although the details thereof are basically the same as the flowchart (see FIG. 11) in the first embodiment, the operation of the pitch processing tool 6 is added. Therefore, the flowchart according to the second embodiment will be described in terms of steps different from those of the flowchart according to the first embodiment with "'" added to step reference numerals thereof.

First, at first step S1', the circumferential speed of the outer circumferential surface of the pitch processing tool 6 around the axis thereof (set substantially equal to the speed of feeding of the wire rod M by the feed rollers 2*a*, 2*b*) is also read as the various pieces of information in addition to those of the first embodiment described above, and the rotations of the feed rollers 2*a*, 2*b*, the rotating roller 5, and the pitch processing tool 6 are started at S2' to start the coil spring forming for the wire rod M. In this case, since the circumferential speed of the outer circumferential surface of the rotating roller 5 and the circumferential speed of the outer circumferential surface of the pitch processing tool 6 are substantially equal to the speed of feeding of the wire rod M by the feed rollers 2*a*, 2*b*, the frictional force between the outer circumferential surface and the wire rod M can be kept considerably low not only for the rotating roller 5 but also for the pitch processing tool 6.

After the process of S2' is completed, if it is determined in the determination of next step S3 that the wire rod M has been fed out by a predetermined length and a coil spring having a predetermined axial length has been formed, the operation goes to S4', and the rotations of the feed rollers 2*a*, 2*b*, the rotating roller 5, and the pitch processing tool 6 are stopped at S4'. At next step S5, the formed coil spring is cut off from the subsequent wire rod M, and a return is made to S2' described above so as to manufacture a new coil spring.

The third embodiment shown in FIG. 14 is a modified example of the coil spring manufacturing apparatus 1 according to the first embodiment.

In the coil spring manufacturing apparatus 1 according to the third embodiment, the columnar cored bar 4 is arranged to cross the feed direction of the wire rod M from the wire rod guide 3 (the rightward direction of FIG. 14), and the cored bar 4 is supported by an attaching member (not shown) in such away as to rotate around the axis thereof. The rotating roller 5 is brought into contact with the outer circumferential surface of this cored bar 4 via the wire rod M fed out from the wire rod guide 3. Therefore, when the rotating roller 5 is rotationally driven around the axis thereof, the cored bar 4 is rotated around the axis thereof in the direction opposite to the rotating roller 5, so that the wire rod M fed out from the wire rod guide 3 is formed into a coil shape, and the wire rod formed into a coil shape is wound around the outer circumferential surface of the cored bar 4 (forming of a coil spring). Subsequently, when the wire rod M is formed into a coil shape having a predetermined axial length, the rotary drive of the rotating roller 5 is stopped, and the wire rod formed into the coil shape is cut off from the subsequent wire rod by the cutter 7.

In this case, the cored bar 4 may independently be rotationally driven by a rotary drive source, and the circumferential speed of the outer circumferential surface of the cored bar 4 may be made equal to the circumferential speed of the rotating roller outer circumferential surface 5*a*.

Although the embodiments have been described, the present invention include the following forms.

(1) The guide groove 11*a* (11*b*) is formed only on the mating surface 10*a* (10*b*) of the one guide member 9*a* (9*b*) out of a pair of the guide members 9*a*, 9*b*, and the guide hole 12 is made up of the guide groove 11*a* (11*b*) inside the wire rod guide 3.

(2) An integrally molded product having a through-hole as the guide hole 12 is used as the wire rod guide 3.

(3) The rotating shaft 15 etc. are used as a rotating body.

(4) The arrangement of the pitch processing tool is determined depending on a winding direction of the coil spring to be formed. In particular, when the coil spring to be formed is a right-handed spring, the tool is allowed to enter the coil spring to be formed from obliquely above (see FIGS. 1 to 3), and when the coil spring to be formed is a left-handed spring, the tool is allowed to enter the coil spring to be formed from obliquely below.

Accordingly, when the coil spring to be formed is a left-handed spring, the cutter 7 is disposed on the lower side of the coil spring to be formed.

EXPLANATIONS OF LETTERS OR NUMERALS

1 coil spring manufacturing apparatus
2*a*, 2*b* feed roller
3 wire rod guide
4 cored bar (winding tool)
5 rotating roller (rotating body)
5*a* rotating roller outer circumferential surface
6 pitch processing tool
8 servomotor (rotary drive source)
20 servomotor (rotary drive source)
33 servomotor (pitch processing tool rotary drive source)
O1 rotating roller axis
O2 pitch processing tool axis
U control unit

The invention claimed is:

1. A cold-forming method of manufacturing a coil spring by serially pressing a wire rod being straightly fed out by a wire rod guide against an outer circumferential surface of a single rotating body serving as a coil forming tool on one side and being wound on another side by a winding tool disposed adjacent to the wire rod guide to form the wire rod into a coil shape, comprising the step of:

rotationally driving the rotating body as the wire rod is fed straight out by a rotary drive force of a rotary drive source such that a portion on the outer circumferential surface of the single rotating body pressed against the wire rod moves toward the same side as the advancing side of the wire rod, and such that a circumferential speed of the outer circumferential surface of the rotating body is set to about a feed speed of the wire rod by using the feed speed of the wire rod as a target value, wherein a stationary winding tool is disposed adjacent to the wire rod guide and winds the wire rod fed out from the wire rod guide into the coil shape, and wherein the wire rod is curved only by the stationary winding tool and the single rotating body between a first point (P1) corresponding to an exit of the wire rod guide and a second point (P2) corresponding to a closest point between the winding tool and the single rotating body.

2. The method of manufacturing a coil spring according to claim 1, wherein a wire rod having a predetermined diameter less than 0.3 mm is used as the wire rod being fed out.

3. The method of manufacturing a coil spring according to claim 2, wherein the wire rod being fed straight out is serially pressed against an outer circumferential surface of the single rotating body to form the wire rod into a coil shape having an inner diameter of about 1 mm.

4. The method of manufacturing a coil spring according to claim 1, wherein a shaft-shaped pitch processing tool is provided, wherein when the wire rod is formed into a coil shape, the pitch processing tool is pressed against the wire rod to displace the wire rod in an axial direction of the coil spring to be formed for performing pitch processing, and wherein as the wire rod is fed straight out, the pitch processing tool is rotationally driven by a rotary drive force of a pitch processing tool rotary drive source such that a portion pressed against the wire rod on an outer circumferential surface of the pitch processing tool moves toward the same side as the advancing side of the wire rod.

5. The method of manufacturing a coil spring according to claim 4, wherein when the pitch processing tool is rotationally driven, a circumferential speed of the outer circumferential surface of the pitch processing tool is set to about a feed speed of the wire rod by using the feed speed of the wire rod as a target value.

6. The coil spring manufacturing apparatus according to claim 1, wherein the wire rod is wound around the winding tool between the first and second points (P1) and (P2).

7. The coil spring manufacturing apparatus according to claim 1, wherein between the first point and the second point, there is only one rotating body that contacts the wire rod.

8. A cold-forming method of manufacturing a coil spring by serially pressing a wire rod being straightly fed out by a wire rod guide having a body including a guide hole against an outer circumferential surface of a single rotating body serving as a coil forming tool on one side and being wound on another side by a stationary winding tool disposed adjacent to the wire rod guide to form the wire rod into a coil shape, comprising the steps of:

rotationally driving the rotating body as the wire rod is fed straight out by a rotary drive force of a rotary drive source such that a portion on the outer circumferential surface of the rotating body pressed against the wire rod moves toward the same side as the advancing side of the wire rod, and such that a circumferential speed of the outer circumferential surface of the rotating body is set to about a feed speed of the wire rod by using the feed speed of the wire rod as a target value, and using only the single rotating body and the winding tool to curve the wire rod between a first point (P1) corresponding to an exit of the wire rod guide and a second point (P2) corresponding to a closest point between the winding tool and the rotating body.

9. The method of manufacturing a coil spring according to claim 8, wherein a rotationally-drivable, shaft-shaped pitch processing tool is provided, wherein when the wire rod is formed into a coil shape, the pitch processing tool is pressed against the wire rod to displace the wire rod in an axial direction of the coil spring to be formed for performing pitch processing, and wherein when the pitch processing tool is rotationally driven, a circumferential speed of the outer circumferential surface of the pitch processing tool is set to about a feed speed of the wire rod by using the feed speed of the wire rod as a target value.

10. The method of manufacturing a coil spring according to claim 8, wherein between the first point and the second point, there is only one rotating body that contacts the wire rod.

11. A cold-forming coil spring manufacturing apparatus comprising:

a rotating body having an outer circumferential surface against which a wire rod being fed out is serially pressed for forming into a coil shape, the rotating body being connected to a rotary drive source such that the rotating body is rotated around an axis of the rotating body, the rotary drive source rotationally driving the rotating body as the wire rod is fed straight out, the rotary drive source being set in relation to the rotary drive of the rotating body such that a portion pressed against the wire rod on the outer circumferential surface of the rotating body moves toward the same side as the advancing side of the wire rod, the rotary drive source being adjusted to set a circumferential speed of the outer circumferential surface of the rotating body to about a feed speed of the wire rod by using the feed speed of the wire rod as a target value, wherein the rotating body is a single rotating body, wherein a wire rod guide having a body including a guide hole straightly feeds out the wire rod, and a stationary winding tool disposed adjacent to the wire rod guide winds a wire rod fed out from the wire rod guide into the coil shape, and wherein the wire rod is curved only by the stationary winding tool and the single rotating body between a first point (P1) corresponding to an exit of the wire rod guide and a second point (P2) corresponding to a closest point between the stationary winding tool and the single rotating body.

12. The coil spring manufacturing apparatus according to claim 11, wherein the wire rod being fed straight out has a predetermined diameter less than 0.3 mm.

13. The coil spring manufacturing apparatus according to claim 11, wherein the winding tool has an arc-shaped outer circumferential surface around which the wire rod fed from the wire rod guide is wound, and wherein the single rotating body is disposed to be bought into contact with the arc-shaped outer circumferential surface of the winding tool via the wire rod.

14. The coil spring manufacturing apparatus according to claim 13, wherein the wire rod being fed out has a predetermined diameter less than 0.3 mm.

15. The coil spring manufacturing apparatus according to claim 11, comprising a shaft-shaped pitch processing tool pressed against the wire rod to displace the wire rod in an axial direction of the coil spring to be formed for performing pitch processing when the wire rod is formed into a coil shape, wherein the pitch processing tool is connected to a pitch processing tool rotary drive source such that the pitch processing tool is rotated around an axis of the pitch processing tool, and wherein the pitch processing tool rotary drive source rotationally drives the pitch processing tool as the wire rod is fed straight out, and is set in relation to the rotary drive of the pitch processing tool such that a portion pressed against the wire rod on an outer circumferential surface of the pitch processing tool moves toward the same side as the advancing side of the wire rod.

16. The coil spring manufacturing apparatus according to claim 15, wherein the pitch processing tool rotary drive source is adjusted to set a circumferential speed of the outer circumferential surface of the pitch processing tool to about a feed speed of the wire rod by using the feed speed of the wire rod as a target value.

17. The coil spring manufacturing apparatus according to claim 11, wherein between the first point and the second point, there is only one rotating body that contacts the wire rod.

18. A cold-forming coil spring manufacturing apparatus comprising: a rotating body having an outer circumferential surface against which a wire rod being fed straight out is serially pressed for forming into a coil shape, the rotating body being connected to a rotary drive source such that the rotating body is rotated around an axis of the rotating body, the rotary drive source rotationally driving the rotating body as the wire rod is fed straight out, the rotary drive source being set in relation to the rotary drive of the rotating body such that a portion pressed against the wire rod on the outer circumferential surface of the rotating body moves toward the same side as the advancing side of the wire rod, the coil spring manufacturing apparatus comprising a shaft-shaped pitch processing tool pressed against the wire rod to displace the wire rod in an axial direction of the coil spring to be formed for performing pitch processing when the wire rod is formed into a coil shape, the pitch processing tool being connected to a pitch processing tool rotary drive source such that the pitch processing tool is rotated around an axis of the pitch processing tool, the pitch processing tool rotary drive source rotationally driving the pitch processing tool as the wire rod is fed out, the pitch processing tool rotary drive source being set in relation to the rotary drive of the pitch processing tool such that a portion pressed against the wire rod on an outer circumferential surface of the pitch processing tool moves toward the same side as the advancing side of the wire rod, wherein the pitch processing tool rotary drive source is adjusted to set a circumferential speed of the outer circumferential surface of the pitch processing tool to about a feed speed of the wire rod by using the feed speed of the wire rod as a target value, wherein the rotating body is a single rotating body, wherein a wire rod guide having a body including a guide hole straightly feeds out the wire rod, and stationary winding tool disposed adjacent to the wire rod guide winds a wire rod fed out from the wire rod guide into the coil shape, and wherein the wire rod is curved only by the stationary winding tool and the single rotating body between a first point (P1) corresponding to an exit of the wire rod guide and a second point (P2) corresponding to a closest point between the winding tool and the rotating body.

19. The coil spring manufacturing apparatus according to claim 18, wherein between the first point and the second point, there is only one rotating body that contacts the wire rod.

* * * * *